US005110181A

United States Patent [19]

Simjian

[11] Patent Number: 5,110,181

[45] Date of Patent: May 5, 1992

[54] CHAIR WITH MOVING SEAT AND MOVING MIRROR

[75] Inventor: Luther G. Simjian, Fort Lauderdale, Fla.

[73] Assignee: Command Automation, Inc., Fort Lauderdale, Fla.

[21] Appl. No.: 716,267

[22] Filed: Jun. 17, 1991

Related U.S. Application Data

[63] Continuation of Ser. No. 550,449, Jul. 10, 1990, abandoned.

[51] Int. Cl.[5] ..... A47C 7/62

[52] U.S. Cl. ..... 297/185; 297/349

[58] Field of Search ..... 297/185, 349; 350/632

[56] References Cited

U.S. PATENT DOCUMENTS 2,218,302 10/1940 Simjian ..... 88/74

*Primary Examiner*—Kenneth J. Dorner

*Assistant Examiner*—Milton Nelson, Jr.

[57] ABSTRACT

A chair construction in which a rotating seat causes coordinated counterrotation of a mirror secured to an arm extending upwardly from a generally horizontally disposed beam underneath the seat. The chair construction includes a stationary center post protruding through the beam causing the beam to rotate about the center post. Linkage means couple the rotatably mounted mirror arm to the stationary center post of the chair to cause the face of the mirror during rotation of the seat to assume a positon substantially tangential to a circle having its center forward of the center of rotation to the seat. A skirt mounted to the beam rotates with the beam and covers the rotating mechanism.

5 Claims, 5 Drawing Sheets

CHAIR WITH MOVING SEAT AND MOVING MIRROR

REFERENCE TO PRIOR APPLICATION

This application is a continuation of Application for U.S. Letters Patent Ser. No. 07/550,449 filed July 10, 1990.

BRIEF SUMMARY OF THE INVENTION

This invention is related to a chair construction having a mirror mounted for movement with the seat of the chair in a coordinated manner. Chairs of this type have been disclosed by me previously in the following U.S. Patents:

| U.S. Pat. No. | Date of Issue |
|---|---|
| 2,218,301 | Oct. 15, 1940 |
| 2,218,302 | Oct. 15, 1940 |
| 2,510,351 | June 6, 1950 |
| 2,811,083 | Oct. 29, 1957 |
| 2,987,727 | Aug. 4, 1959 |
| 3,806,189 | Apr. 23, 1974 |
| 3,905,642 | Sept. 16, 1975 |
| 4,557,520 | Dec. 10, 1985 |

The foregoing patents reveal a chair construction in which a rotating seat is adapted to cause coordinated rotation of a mirror supported by the chair for enabling a person seated on the seat of the chair to observe an image from the rear of the head in a stationary mirror disposed in front of the chair, for instance in a mirror hanging from a wall, or a mirror upstanding from a dresser. As the person sitting on the chair rotates the seat, the mirror undergoes coordinated counterrotation relative to the rotation of the seat, but importantly also the mirror undergoes a pivotal motion relative to the vertical axis in order to present in the stationary mirror a substantially stationary image from various points along the rear of the head of the person. In this manner, the person seated on the chair may view hair and clothing at the rear or sides of the head, which views are normally not visible. This enables the person to make proper adjustments to the hair and clothing.

The present invention relates to certain improvements of the chair construction, particularly the mechanism causing responsive to the rotation of the seat, the coordinated counterrotation of the mirror arm to which the mirror is mounted. The mechanism is simplified and is completely concealed for aesthetic and safety purposes. Other improvements are present with a view of lower cost of manufacture and improved reliability.

DETAILED DESCRIPTION OF THE INVENTION

Figure 1:
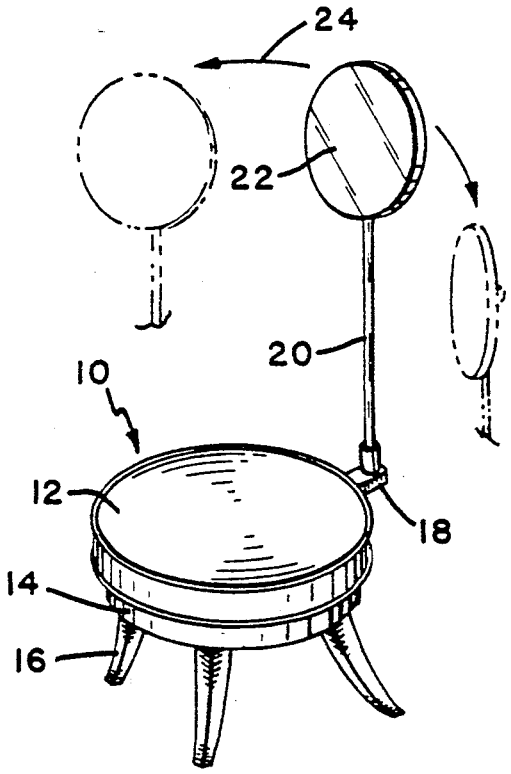
FIG. 1 is a perspective view of the chair with moving seat and moving mirror.

Referring now to the figures and FIG. 1 in particular, there is shown a chair 10 having a rotatable seat 12, a rotatable drum mechanism 14 and a set of legs 16 for supporting the chair. A horizontal beam 18 is secured to the drum mechanism and rotates therewith in counterrotation with the seat 12. The beam 18 supports at its protruding end toward the rear of the chair a substantially vertical mirror support arm 20 having at its distal end fastened thereto a mirror 22 whose front surface reflects an image toward a stationary mirror, not shown, disposed in front of the chair 10. Arrows 24 depict the motion of the mirror arm 20 and mirror 22, which motion is in counterrotation with the rotation of the seat 12. Thus, if the seat 12 is rotated, for instance, sixty degrees in the clockwise direction, the arm 20 will rotate sixty degrees in the counterclockwise direction.

Figure 2:
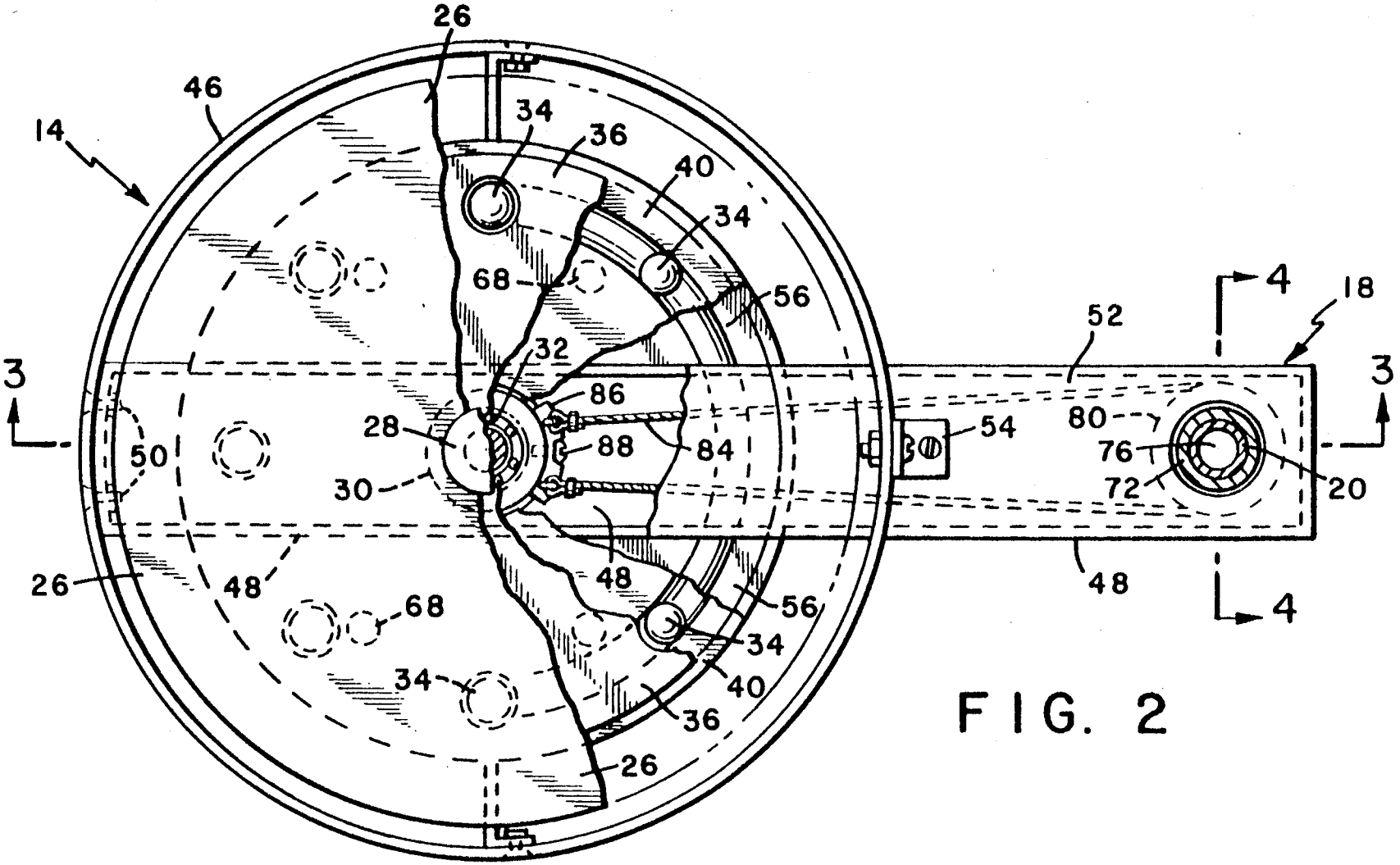
FIG. 2 is a top plan view of the chair, partly in section.
Figure 3:
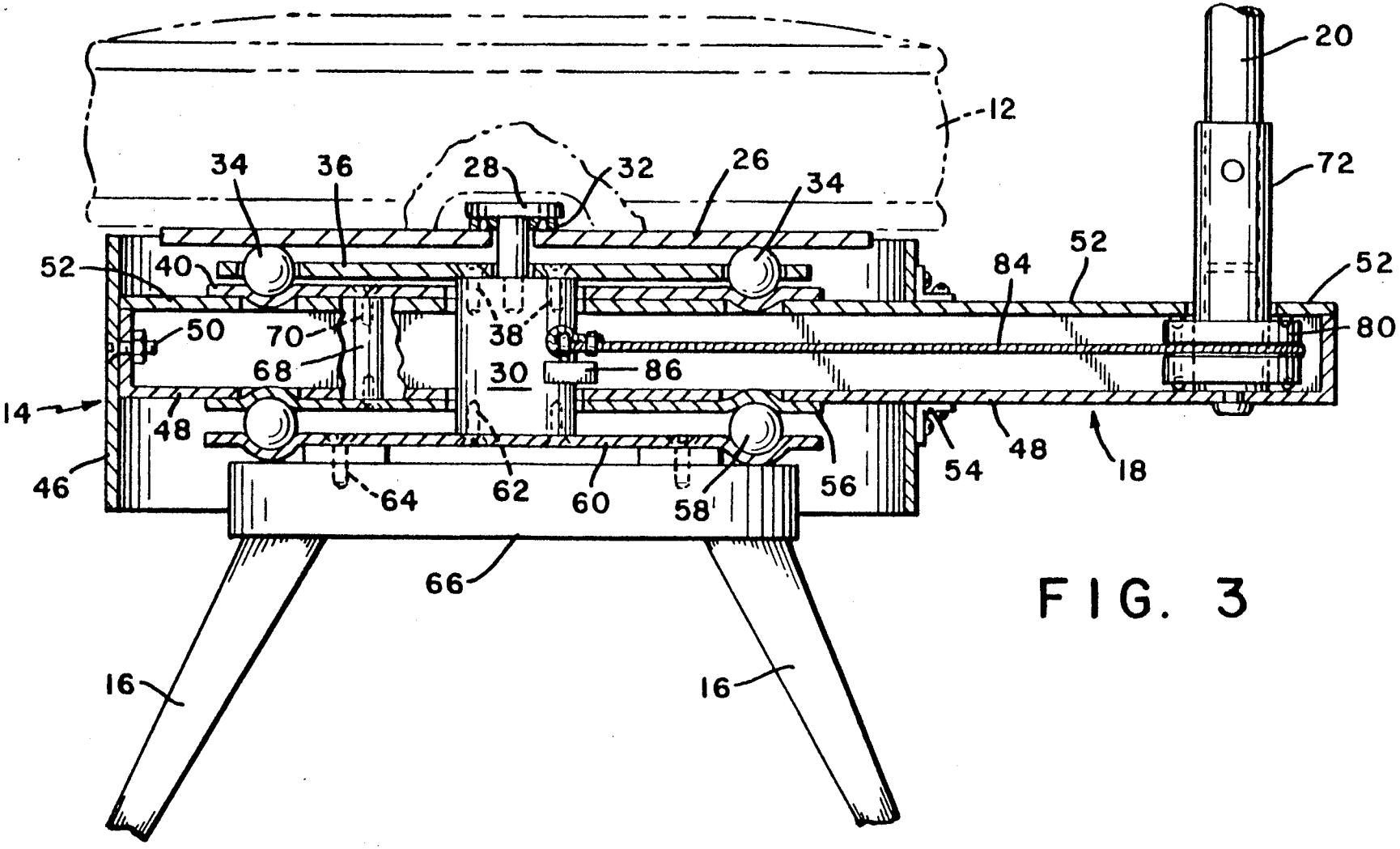
FIG. 3 is a vertical view along section lines 3—3 in FIG. 2.

FIGS. 2 and 3 more clearly illustrate the construction of the chair and of the drum mechanism. The seat 12 is secured to a seat mounting plate 26 by suitable fastening means, not shown. The seat mounting plate 26, in turn, is fastened at its center by means of a headed screw bolt 28 to a stationary center post 30. A thrust bearing 32 disposed underneath the head of the bolt 28 permits the seat mounting plate 26 to rotate relative to the stationary center post 30. The underside of the seat mounting plate 26 is in forced contact with a set of bearing balls 34 which are retained in spaced relation from one another within suitable apertures of a stationary ball retaining plate 36. The plate 36 itself is secured to the stationary center post 30 by a set of screws 38, thus causing the plate 36 to be stationary. The balls 34 at their underside engage the raceway of a bearing race plate 40. Therefore, as the seat 12 with seat mounting plate 26 is rotated, such rotation is transmitted upon the set of bearing balls 34 which are caused to rotate in place about their respective center and cause coordinated counterrotation of the race plate 40.

Numeral 18 refers to the horizontally disposed beam forming a part of the drum assembly 14. The assembly includes the plates 26 and 40, and a cylindrical metal skirt 46 fastened to a horizontal channel 48, the latter forming a part of the beam 18, by screw means 50. The channel is covered by cover plate means 52 provided with suitable slots for receiving therein the ball raceway of the plate 40. The cover means 52 and the channel 48 are fastened, moreover, to the skirt 46 by means of L-shaped brackets and suitable screw means 54. Complementary slots are provided in the channel 48 for receiving therein the raceway of a lower race plate 56 which retains a second set of bearing balls 58, which, in turn, are supported by a substantially identical lower race plate 60. The race plate 60 is secured by screw means 62 to the stationary center post 30, and by further screw means 64 and spacers to a leg support 66 which supports the chair legs 16.

A set of stiffening posts 68 are disposed between the rotatable lower bearing race plate 40 of the upper bearing balls 34 and the rotatable upper race plate 56 of the lower bearing balls 58. Screw means 70 extending respectively from plates 40 and 56 hold the posts 68 in place and fix these plates to one another.

Hence, as the seat 12 rotates about the center of the stationary post 30, the horizontal beam 18 with skirt 46 is driven in concomitant counterrotation about the centrally disposed stationary post 30. As will be noted, the post 30 extends through the horizontally disposed beam and the beam rotates about the post 30. The lower bearing balls 58 provide relief between the rotatable beam 18 and the stationary race plate 60 affixed to the stationary center post 30. The cylindrical skirt 46 rotating with the beam 18 covers the rotating mechanism as it extends vertically from underneath the seat 12 to the leg support 66. As a result, the exit aperture for the arm 18 toward the rear of the chair is limited to the size of the channel 48 with cover plate means 52, instead of a horizontal slot commensurate with the rotational excursion of the beam required in prior art constructions. Hence, the present construction incorporates important safety features.

Figure 4:
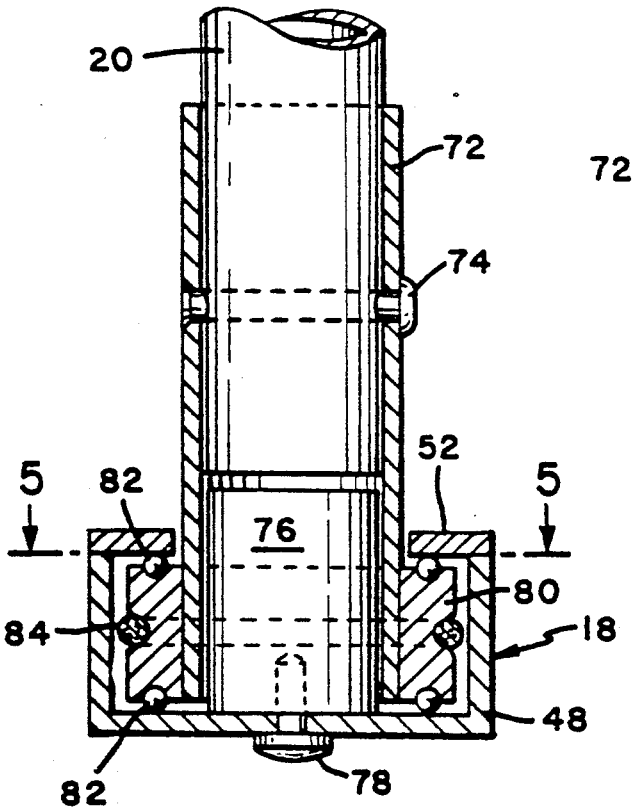
FIG. 4 is a sectional view along lines 4—4 in FIG. 2.

The lower end of the vertical mirror support arm 20 is secured to a sleeve 72 by a suitable pin 74, see also FIG. 4. A post 76 supports the sleeve 72 and is fastened to the channel 48 of the beam 18 by screw fastener 78. There is provided also a grooved wheel or pulley 80 which is pressed upon the outer surface of the sleeve 72. The pulley 80 with sleeve 72 can pivot or rotate about the substantially vertical axis through the mirror arm 20 as a result of suitable bearing balls 82 interposed between the pulley 80 and the beam channel 48 and its cover plate means 52 respectively. Therefore, the mirror arm 20, while rotating about the seat 12, also is adapted to pivot or rotate about its substantially vertical axis as a result of linkage or drive means rotating the pulley 80, which, in turn, transmits its rotation to the sleeve 72 to which the mirror arm 20 is fastened by pin 74.

Figure 5:
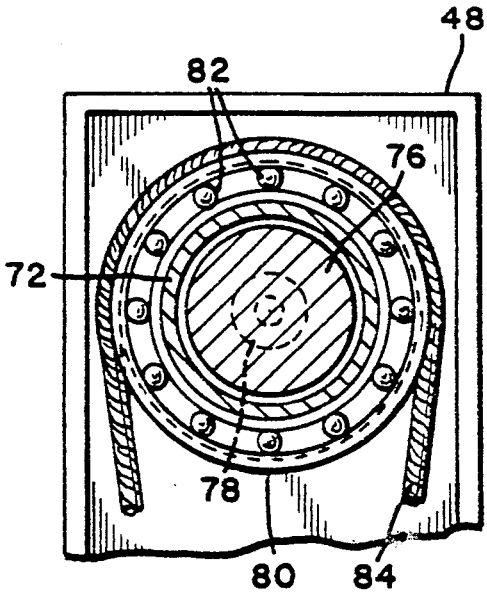
FIG. 5 is a sectional view along lines 5—5 in FIG. 4.

Referring now to FIGS. 2 and 5, there is shown one embodiment of such linkage means. An open ended flexible drive means, such as a belt, rope, cable or chain 84, is looped around the pulley 80 and has its ends fastened to a yoke 86 secured to the stationary center post 30 by screw means 88.

Figure 6:
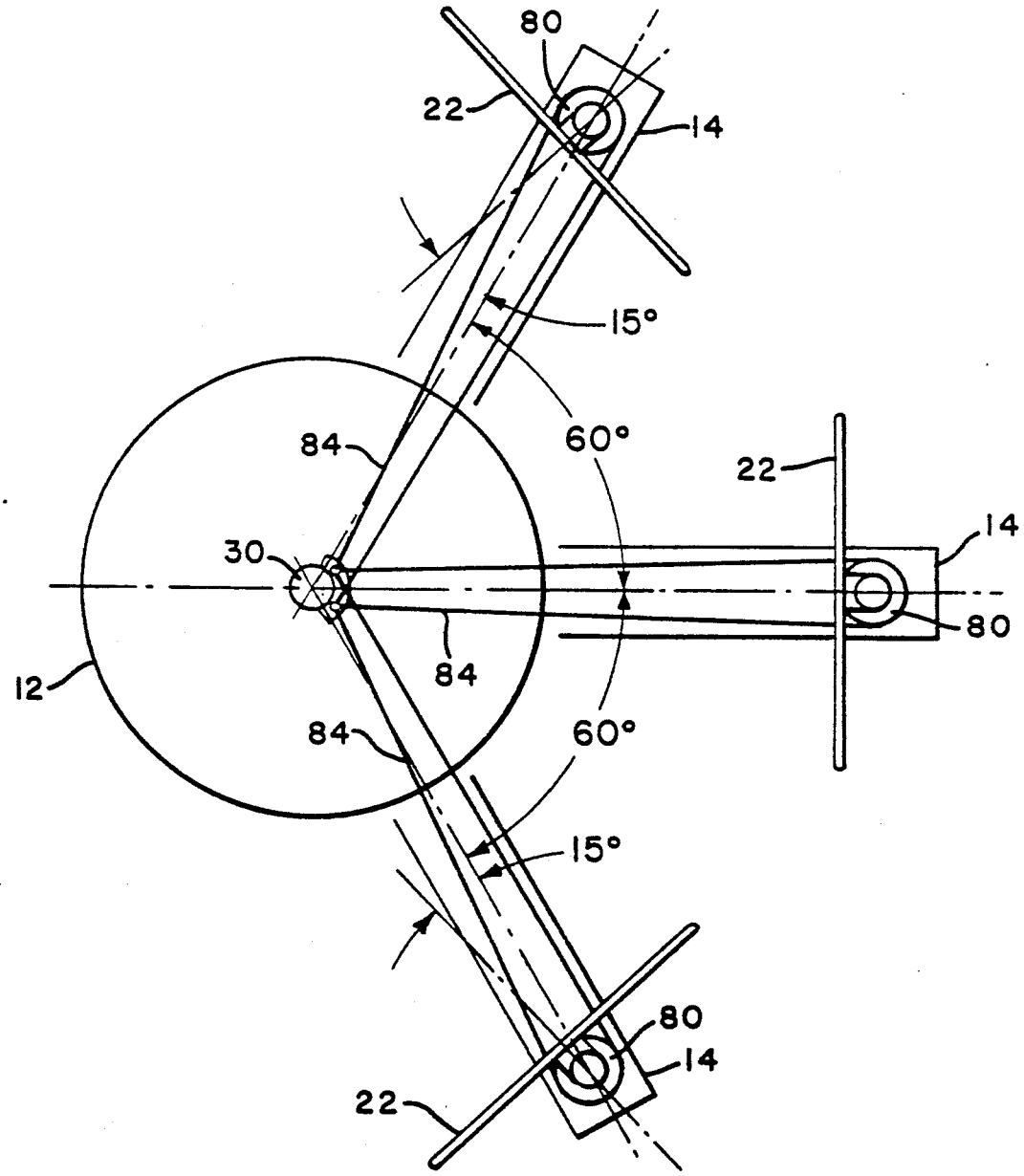
FIG. 6 is an explanatory drawing for illustrating the motion of the mirror about the vertical axis responsive to the rotation of the mirror arm.

FIG. 6 illustrates the motions of the beam 18 with mirror arm 20 and mirror 22. Assuming that the seat is rotated clockwise about an angle of sixty degrees, the beam 18 with mirror arm is rotated concomitantly counterclockwise by sixty degrees. Rotation of the beam and mirror arm causes a shortening of one leg of the flexible cable or rope 84 and a lengthening of the other leg. This causes a clockwise rotation of the pulley 80 and of the mirror arm 20 with mirror 22 about the vertical axis of the mirror arm 20. The diameter of the pulley 80 is so dimensioned that, in a preferred embodiment, a sixty degrees rotation of the seat and beam with mirror arm supported on the beam causes a fifteen degrees pivotal motion of the mirror about the substantially vertical axis. Thus, the face of the mirror is maintained tangential to a circle having its center forward of the center of rotation of the seat and, preferably, forward of the seat 12 to coincide substantially with the plane of a stationary mirror disposed in front of the chair 10. FIG. 6 illustrates such motions in the clockwise and counterclockwise directions. If a sprocket chain is used instead of a flexible belt or rope, the pulley 80 will take on the form of a sprocket wheel. Suitable stops, not shown, can be provided to limit the angular excursion of the seat and beam.

Another important aspect of the invention resides in the fact that the drive mechanism, i.e. belt, cable, chain, etc. and pulley are enclosed within the beam enclosure, thus hidden for improving the aesthetic appearance of the chair.

The mounting of the mirror to the mirror arm may readily include a pivoting mechanism for pivoting the mirror about a horizontal axis as shown in U.S. Pat. No. 4,557,520 for tilting the mirror in the upward or downward direction.

Figure 7:
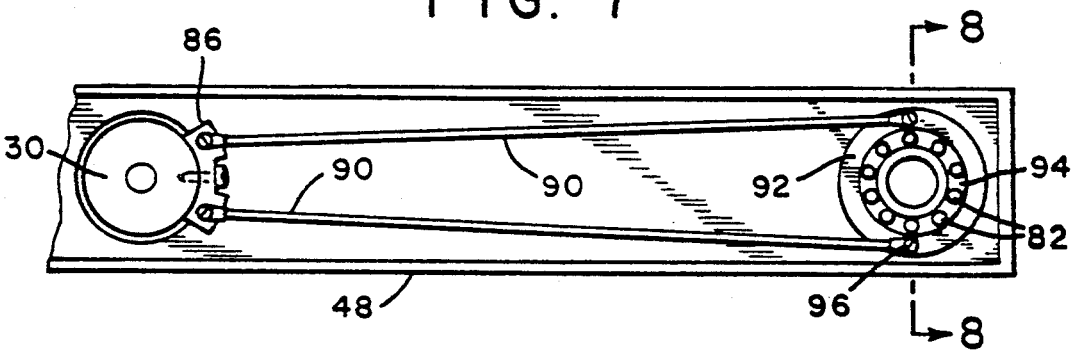
FIG. 7 is a plan view of an alternative embodiment of the linkage mechanism.
Figure 8:
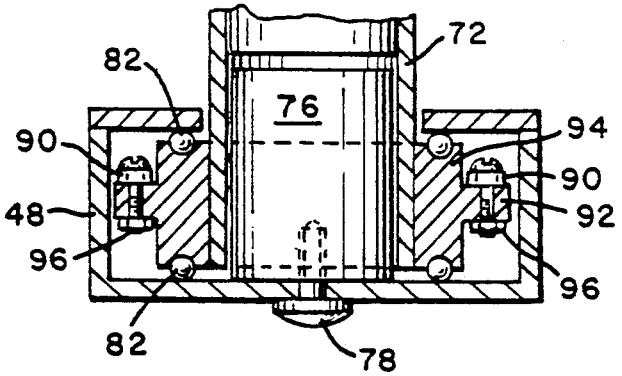
FIG. 8 is a sectional view along lines 8—8 in FIG. 7.

An alternative linkage mechanism is depicted in FIGS. 7 and 8 wherein the flexible cable or rope 84 has been replaced by a pair of rigid link arms 90 which are connected with one end to the yoke 86 secured to post 30, and with the other end are connected to the annular flange 92 of sleeve 94 using screw means 96. The sleeve 94 is pressed upon sleeve 72. It will be apparent that this arrangement is operative only for a limited rotational motion, such as the fifteen degrees rotation illustrated in FIG. 6. The screw means 96 and the screw means connecting the link arm to the yoke, permit the slight angular motion of the respective link arms.

Figure 9:
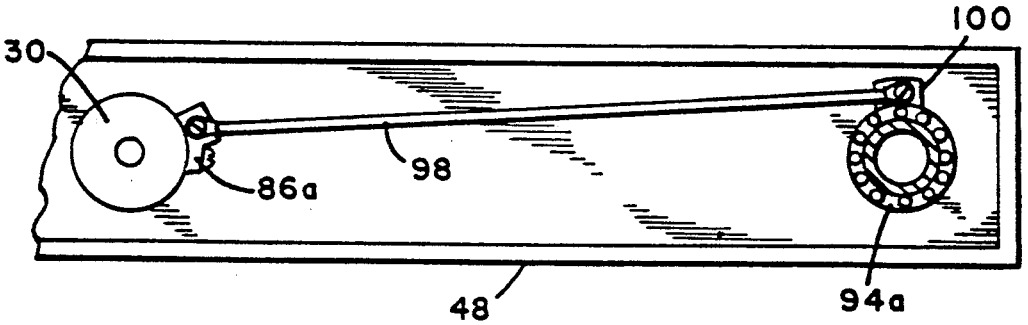
FIG. 9 is a plan view showing a further modification of the linkage mechanism shown in FIG. 7.

A further alternative construction is shown in FIG. 9 wherein only a single rigid link arm 98 is used. One end of the arm 98 is coupled to the yoke **86*a* while the other end is connected to a tab 100 of the sleeve 94*a*. As shown in FIGS. 7 and 8, the mirror arm is caused to pivot about its substantially vertical axis responsive to the rotation of the seat and counterrotation of the beam which carries the mirror arm 20**.

While there has been described and illustrated a preferred embodiment of my invention and certain modifications thereof have been indicated, it will be apparent to those skilled in the art that various further changes and modifications may be made without departing from the spirit and principle of this invention, which shall be limited only by the scope of the appended claims.

What is claimed is:

1. A chair with moving seat and moving mirror comprising: a stationary center post having an upper end and a lower end;

a seat mounting plate fastened for rotation about its center to the upper end of said center post;

a first set of bearing balls disposed for frictionally engaging the underside of said seat mounting plate;

a stationary ball retaining plate fastened to the upper end of said center post for retaining the balls of said first set in spaced relationship to one another and for providing rotation of the respective balls in place;

a stationary leg support disposed underneath said center post;

a ball race plate supporting a second set of bearing balls disposed between the lower end of said center post and said leg support and fastened respectively to said center post and to said leg support;

a horizontally disposed beam having one end extending toward the rear of the chair and being coupled between said first set of bearing balls and said second set of bearing balls, whereby responsive to the rotation of said seat mounting plate the balls of said first set are caused to rotate in place, thereby causing said beam to be driven in coordinated counterrotation with said seat mounting plate, and said second set of bearing balls provide relief for such rotation relative to said stationary center post and said leg support;

a substantially vertically disposed mirror support arm rotatably mounted at its lower end to said beam end extending toward the rear of said seat mounting plate, and said arm supporting at its upper end a mirror having a reflecting face plate for reflecting an image toward a stationary mirror disposed in front of said chair;

linkage means connected between said lower end of said mirror support arm and said stationary center post for causing said arm with mirror mounted thereto to rotate about its substantially vertical axis in the same direction as said seat mounting plate while said beam undergoes counterrotation relative to said seat mounting plate, whereby said mirror face plate, responsive to the rotation of said seat mounting plate and the coordinated counterrotation of said beam, is caused to assume a position substantially tangential along a circle having its center located forward of the axis of rotation of said seat mounting plate for presenting in the stationary mirror a substantially stationary image from the rear of a person sitting on the chair.

2. A chair with moving seat and moving mirror as set forth in claim 1, said center post extending through said horizontally disposed beam causing said beam to rotate about said center post.

3. A chair with moving seat and moving mirror as set forth in claim 1, and a cylindrical skirt attached to said beam for rotating motion therewith.

4. A chair with moving seat and moving mirror as set forth in claim 3, said skirt extending vertically substantially from a position opposite said seat mounting plate to said leg support.

5. A chair with moving seat and moving mirror as set forth in claim 3, said skirt having an opening through which said beam extends toward the rear of the chair.

* * * * *